US006025703A

United States Patent [19]

Björkengren

[11] Patent Number: 6,025,703

[45] Date of Patent: Feb. 15, 2000

[54] SYSTEM AND METHOD FOR COMPENSATING FOR UNWANTED VOLTAGE DROPS

[75] Inventor: Ulf Björkengren, Bjärred, Sweden

[73] Assignee: Telefonaktiebolaget LM Ericsson, Stockholm, Sweden

[21] Appl. No.: 09/032,949

[22] Filed: Mar. 2, 1998

[30] Foreign Application Priority Data

Mar. 6, 1997 [SE] Sweden ..... 9700797

[51] Int. Cl.[7] ..... G05F 1/40

[52] U.S. Cl. ..... 323/280; 323/274

[58] Field of Search ..... 323/274, 276, 323/277, 280, 281, 316

[56] References Cited

U.S. PATENT DOCUMENTS

| | | | |
|---|---|---|---|
| 4,169,243 | 9/1979 | Payne et al. | 324/62 |
| 4,403,196 | 9/1983 | Grandmont | 330/10 |
| 4,585,955 | 4/1986 | Uchida | 323/281 X |
| 4,635,057 | 1/1987 | Schaefer | 323/909 X |
| 5,008,523 | 4/1991 | Davis et al. | 250/214 A |

FOREIGN PATENT DOCUMENTS

| | | |
|---|---|---|
| 2426908 | 12/1979 | France . |
| 2532759 | 9/1984 | France . |

*Primary Examiner*—Y. J. Han

*Attorney, Agent, or Firm*—Burns, Doane, Swecker & Mathis, L.L.P.

[57] ABSTRACT

A voltage drop compensating circuit is disclosed which compensates for unwanted voltage drops along a DC current conductor connected to an integrated circuit. The compensating circuit includes a differential amplifier connected between a voltage supply and the conductor form the integrated circuit which is marred by the voltage drop. One input terminal of the amplifier is connected to the supply lead and an output terminal of the amplifier is connected to the conductor. A feedback network is connected between another input terminal of the amplifier and the integrated circuit. A potential difference between the two input terminals on the amplifier will lead to the amplifier adjusting a potential on the output terminal until the unwanted voltage drop along the conductor is compensated for.

18 Claims, 2 Drawing Sheets

SYSTEM AND METHOD FOR COMPENSATING FOR UNWANTED VOLTAGE DROPS

TECHNICAL FIELD OF THE INVENTION

The present invention relates to an electric circuit and a method for eliminating an influence of a voltage drop along an electric conductor. Particularly voltage drops present along electric leads with high resistivity.

DESCRIPTION OF RELATED ART

Unwanted voltage drops along electric conductors occur in many different situations and environments. The voltage drops occur along power-lines where voltages of several kilovolts are common, as well as in electronic equipment where the voltage is typically only a few volts. Variations in the voltage drops due to e.g. variations of resistivity or current may be particularly unwanted, and may even lead to complete malfunction of the circuit concerned.

Voltage drops due to varying or unpredictable currents can occur in connection with e.g. integrated circuits that have voltage supply terminals connected to externally generated electric potentials. Depending on the level of power consumption in the circuit, varying currents are flowing through the supply terminals. In cases where the circuits are supplied through leads with relatively high resistivity, a large current inevitably leads to a large voltage drop over the supply leads. The voltage drop may get too large, resulting in erroneous voltage levels as sensed by the circuit and erroneous output voltage levels, with consequences as serious as total malfunction of the circuit.

In the American patent U.S. Pat. No. 5,008,523 can be found a circuit relating to compensation of unwanted voltage drops along electric conductors. In essence, the circuit described in U.S. Pat. No. 5,008,523 is a circuit for indicating current emanating from a current generator, such as a photo-diode, having significantly varying internal resistance as well as high-resistance instrumentation leads. This is obtained by connecting the instrumentation leads from the generator to input terminals of an operational amplifier, whereby the output of the operational amplifier drives an output voltage that represents the output current of the generator.

A drawback of the circuit presented in U.S. Pat. No. 5,008,523 is that it is intended for compensating voltage drops between two connection terminals from a current generator circuit. That is, the circuit strives to keep a zero voltage difference between the connection leads.

SUMMARY OF THE INVENTION

The present invention is intended to solve problems as indicated by the above presented background and state-of-the-art. In particular, the invention solves a problem of compensating an unwanted voltage drop along a DC current conductor connected to an integrated circuit.

Another problem solved by the invention is compensating said voltage drop by utilizing no extra connectors of the integrated circuit.

The purpose of the invention is hence to realize a circuit and a method to overcome the above stated problems, applicable in connection with an integrated circuit having current supply conductors with voltage drops.

The realization of a circuit according to the invention is a differential amplifier with a feedback network between the integrated circuit and the amplifier.

More particularly, the inventive apparatus comprises a differential amplifier connected between a voltage supply and the conductor from the integrated circuit which is marred by the voltage drop. One input terminal of the amplifier is connected to the supply lead and an output terminal of the amplifier is connected to the conductor. The feedback network is connected between another input terminal of the amplifier and the integrated circuit.

An advantage gained by the invention is that it is simple, by the fact that it comprises few components. By using an integrated operational amplifier as differential amplifier, together with no more than three resistors, the invention can be realized very economically.

Another advantage is that the inventive circuit can be inserted into already present circuitry, due to the fact that there is no need for extra connectors between the voltage supply and the conductor marred by the voltage drop.

DETAILED DESCRIPTION OF PREFERRED EMBODIMENTS

Figure 3A:
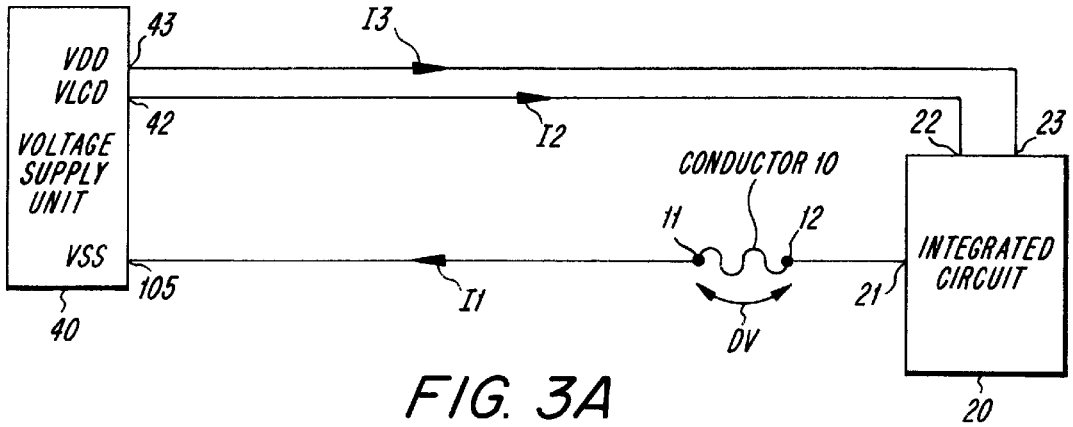
FIG. 3A shows a schematic view of an electric circuit, illustrating a problem solved by the invention.
Figure 3B:
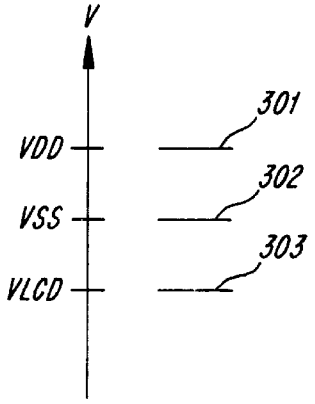
FIGS. 3B and 3C show schematic diagrams of voltage levels, illustrating a problem solved by the invention.
Figure 3C:
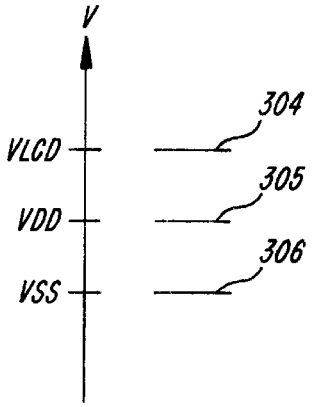

An illustration of a problem solved by the present invention is to be found in FIGS. 3A–3C. FIG. 3A shows schematically an integrated circuit 20 having three voltage terminals, a first voltage terminal 21, a second voltage terminal 22 and a third voltage terminal 23. These three voltage terminals 21,22,23 are connected to a voltage supply unit 40 having three voltage supply terminals, a first supply terminal 105, a second supply terminal 42 and a third supply terminal 43. The first voltage supply terminal 105 is connected to the first voltage terminal 21 of the integrated circuit 20. Similarly, the second and third supply terminals 42,43 are connected to the second and third voltage terminals 22,23 of the integrated circuit 20, respectively.

Between the first supply terminal 105 of the voltage supply unit 40 and the first voltage terminal 21 of the integrated circuit 20 is an electric conductor 10. The conductor 10 has a first connection point 11 connected to the first voltage supply terminal 105 and a second connection point 12 connected to the first voltage terminal 21 of the integrated circuit 20. The conductor 10 is characterized by having a non-negligible electric resistance which, when an electric current I1 is flowing through the conductor 10, causes a non-negligible voltage drop DV between the first connection point 11 and the second connection point 12.

FIG. 3B and 3C, together with FIG. 3A, illustrate two situations in which the three voltage supply terminals 105, 42,43 have different electric potentials 301,302, 303,304, 305,306. Considering a first situation, as illustrated by the levels in FIG. 3B, VSS 302 represent a signal earth level, VDD 301 is a first supply voltage level higher than VSS 302. VLCD 303 is a second supply level which is lower than the VSS signal earth level 302. In a second situation, as illustrated by the levels in FIG. 3C, the level VSS 306 is a signal earth level which is lower than both the VLCD level 304 and the VDD level 305.

In both of these situations, currents I1,I2,I3 will flow between the voltage supply unit 40 and the integrated circuit 20. However, in the second situation, where VSS 306 is the lowest level, the current Ii flowing through the conductor 10 is normally of a higher magnitude than in the first situation.

In the following disclosure of embodiments of the invention, it is this second situation which represents the voltage levels concerned. Naturally, no absolute voltage levels are prescribed since the only relevant information about the levels are their mutual differences.

Figure 1:
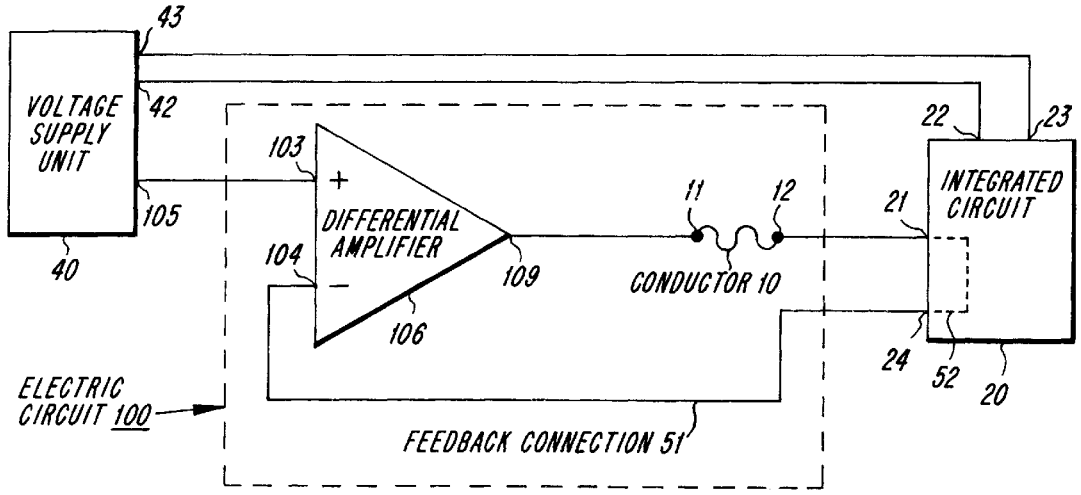
FIG. 1 shows a schematic view of a first embodiment an electric circuit according to the invention.

Starting with a first embodiment of the invention, FIG. 1 shows schematically an electric circuit 100, a voltage supply unit 40 and an integrated circuit 20. As described in connection with FIG. 3A, the integrated circuit 20 and the supply unit 40 are connected to each other with their respective voltage terminals 21,22,23 and 105,42,43 respectively. The conductor 10 with its second connection point 12 is connected to the first voltage terminal 21 of the integrated circuit. However, the first connection point 11 of the conductor 10 is connected to an output terminal 109 of a differential amplifier 106. A first input terminal 103 of the amplifier 106 is connected to the first voltage supply terminal 105 of the supply unit 40. A second input terminal 104 of the amplifier 106 is connected to a fourth terminal 24 on the integrated circuit through a first feedback connection 51. The fourth terminal 24 of the integrated circuit 20 is, internally in the integrated circuit 20, connected to the first voltage terminal 21 as indicated by the dashed line 52.

Since the fourth terminal 24 on the integrated circuit 20 is in contact with the first terminal 21, the electric potential at these terminals 21,24 will be identical. When current is flowing through the conductor 10, the potential at the first terminal 21 of the integrated circuit will differ from the desired potential, which is the potential at the first voltage supply terminal 105. This means that there will be a potential difference between the two input terminals 103,104 of the differential amplifier 106. As a direct consequence of this potential difference, the amplifier 106 adjusts the potential at the output terminal 109 to a potential level at which the difference in potential between the input terminals 103,104 of the amplifier vanishes, as well as the potential difference between the supply terminal 105 and the first terminal 21 of the integrated circuit 20.

Figure 2:
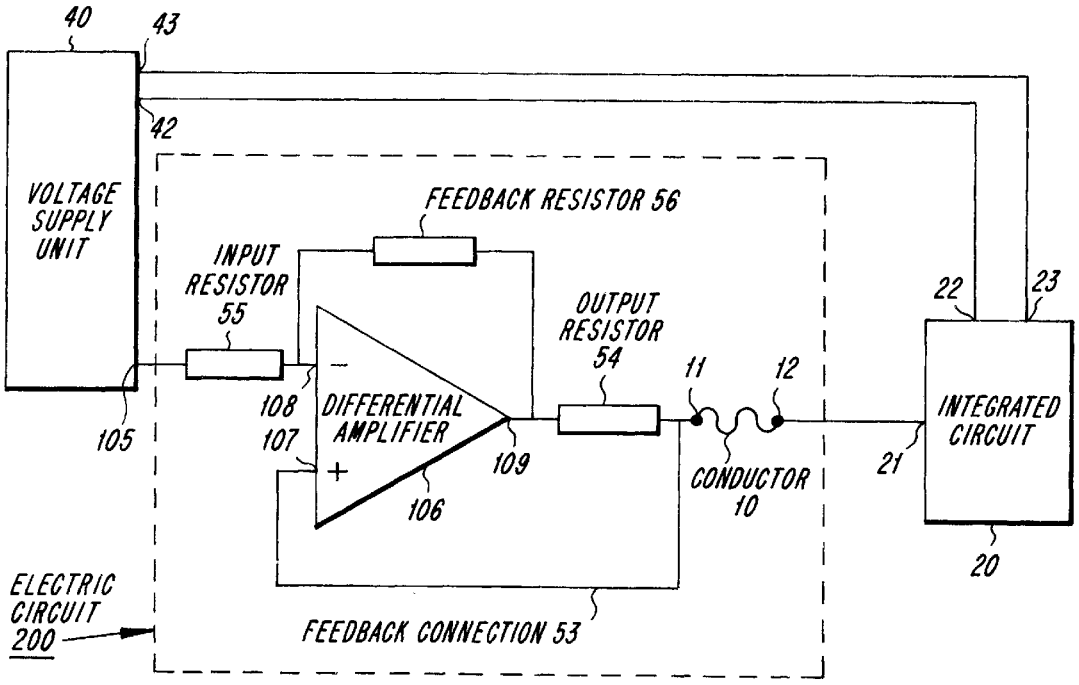
FIG. 2 shows a schematic view of a second embodiment an electric circuit according to the invention.

A second embodiment of the invention is shown schematically in FIG. 2. As in the first embodiment described above, an electric circuit 200 is connected to the first voltage supply terminal 105 of the voltage supply unit 40 and the first voltage terminal 21 of the integrated circuit 20. Also, the second and third voltage supply terminals 42,43 are connected to the second and third voltage terminals 22,23 of the integrated circuit.

The conductor 10 with its second connection point 12 is connected to the first voltage terminal 21 of the integrated circuit. Dissimilar to the first embodiment, the first connection point 11 of the conductor 10 is connected to an output terminal 109 of a differential amplifier 106 via an output resistor 54. Similarly, a first input terminal 108 of the amplifier 106 is connected to the first voltage supply terminal 105 of the supply unit 40 via an input resistor 55. Also in this embodiment there is a feedback connection 53. However, the feedback connection 53 is between the second input terminal 107 of the amplifier 106 and the first connection point 11 of the conductor 10. A second feedback resistor 56 is connected between the first input terminal 108 of the amplifier and the output terminal 109 of the amplifier 106.

To explain the function of this second embodiment, it can be assumed that the potential at the first voltage supply terminal 105 and at the first voltage terminal 21 of the integrated circuit 20 are equal, and that no current is flowing through the conductor 10. Hence, no current can flow through the output resistor 54, and the potential at the output terminal 109 of the amplifier 106 and also at the input terminals 107 and 108, are also equal to the potential at the terminals 105 and 21. Now, if the potential at the first voltage terminal 21 would increase, a current would flow through the conductor 10 and the output resistor 54. This current would increase the potential at the second input terminal 107 of the differential amplifier 106, which decreases the potential at the output terminal 109. A decreasing potential at the output terminal 109 decreases the potential at the first input terminal 108 of the amplifier 106 due to the voltage division of the potential difference between terminals 105 and 109, between the input resistor 55 and the second feedback resistor 56. But the decreasing potential at the output terminal 109 also decreases the potential at the input terminal 107. This decrease in potential at the second input terminal 107 is larger in magnitude than the decrease in potential at the first input terminal 108, since the potential at the first voltage terminal 21 is not constant as at the terminal 105, but follows the changes of the output terminal 109. At a certain decrease of the potential of the output terminal 109 the potential of the input terminals 107 and 108 will be identical, and this state will be steady until the potential of first voltage terminal 21 changes again. To achieve the desired goal that the potential VSS at the first terminal 21 of the integrated circuit 20 will be the same as the potential VSS present at the first supply terminal 105 of the voltage supply unit 40, the value of the resistors 54, 55, and 56 are selected to be identical to the value of the resistance of the conductor 10.

Another way of explaining the function is to recognise that the negative feed back of the differential amplifier 106, together with its almost infinite amplification when implemented using an operational amplifier, will keep the potential difference between the input terminals 107 and 108 to a value close to zero. Now, selecting the resistors 54, 55, and 56 with resistances identical to the value of the resistance of the conductor 10, an observation of the symmetry of the circuit gives that the potential of the terminals 105 and 21 must be equal.

Although the result is the same as in the first embodiment, the differences in construction, including a larger number of components, mean that the circuit 200 can be implemented with no extra connection to the integrated circuit 20.

The differential amplifier 106, discussed above in connection with both FIG. 1 and FIG. 2, is preferably implemented in the form of an integrated operational amplifier. However, nothing precludes an implementation using discrete components with transistors etc. This is of course within the realm of known art, and will not be discussed further here.

Figure 4:
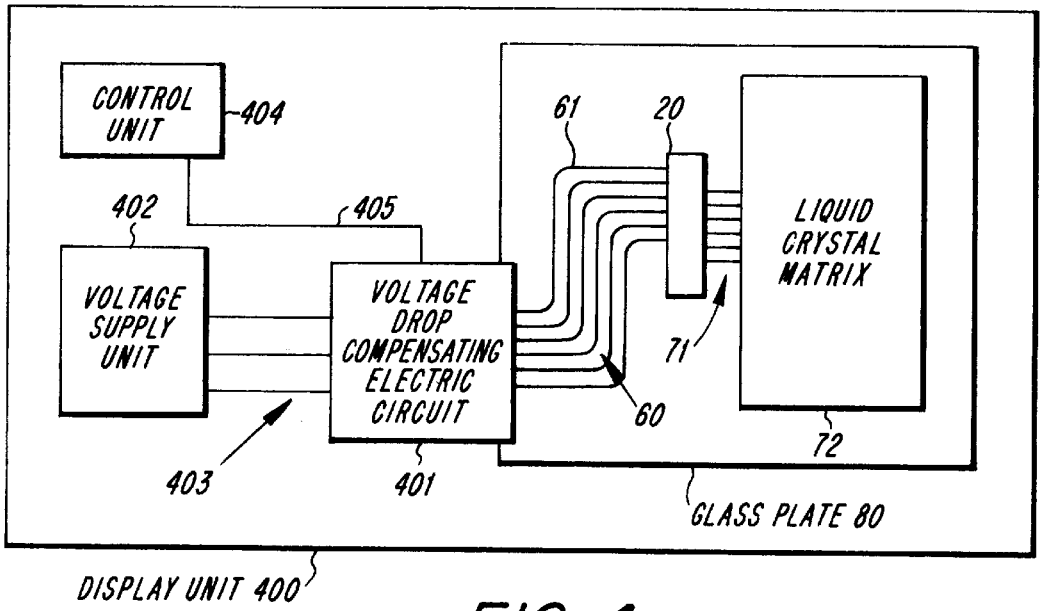
FIG. 4 shows a schematic view of a liquid crystal display unit comprising electric circuitry according to the invention.

A display unit 400 incorporating the present invention is shown schematically in FIG. 4. This embodiment will serve as an illustration to a specific field of implementation, where particular problems with high resistivity electric conductors are present. It is an example of chip-on-glass technology where the problematic voltage drop pertains to Indium Tin Oxide (ITO) paths on a glass plate.

The display unit 400 comprises, as in previous examples, a voltage supply unit 402 and a voltage drop compensating electric circuit 401. To the electric circuit 401 is a control unit 404 connected via a connecting lead 405. The control unit 404 is responsible for sending signals through the connecting lead 405 to a driver circuit 20. The display unit 400 further comprises a glass plate 80 on which plate 80 a liquid crystal matrix 72 is realized. From the matrix 72, a set of relatively short matrix ITO paths 71 connect to the matrix driver integrated circuit 20. The driver circuit 20 is connected to the electric circuit 401 via a set of relatively long connector ITO paths 60, in which set 60 a VSS voltage supply path 61 can be identified. When in operation, the VSS voltage supply path 61 carries a certain electric current which causes an unwanted voltage drop along the path 61 in the same manner as the conductor 10 described above in connection with other embodiments of the invention. The voltage drop is compensated for, by the electric circuit 401 as described above in connection with FIG. 2.

Naturally, the invention is not restricted to compensating voltage drops along ITO paths on glass plates. Other electric equipment where specifications call for conductors with small cross-sectional area, and hence having relatively high resistivity, is of course an area where the invention is applicable.

I claim:

1. Electric circuit (100, 200) for eliminating an influence of a voltage drop (DV) between a first connection point (11) on an electric conductor (10) and a second connection point (12) on the conductor (10), said second connection point (12) being connected to a first terminal (21) of an integrated circuit (20), the electric circuit (100, 200) comprising:

a differential amplifier (106), said differential amplifier (106) having a first input terminal (103, 108) connected to a reference potential (303), and an output terminal (109) connected to the first connection point (11) on the conductor (10), and a feedback network connected to at least a second input terminal (104, 107) of the differential amplifier (106) and to the integrated circuit (20) for compensation of said voltage drop (DV), wherein said first input terminal (108) is an inverting input terminal (108) of the differential amplifier (106), and wherein said feedback network comprises:

a first feedback connection (53) between a non-inverting input terminal (107) of the differential amplifier (106) and the first input terminal (21) of the integrated circuit (20) via the conductor (10), an output impedance unit (54) connected between the output terminal (109) of the differential amplifier (106) and the first connection point (11) on the conductor, and a second feedback impedance unit (56) connected between the inverting input terminal (108) of the differential amplifier (106) and the output terminal (109) of the differential amplifier (106).

2. Electric circuit (100,200) according to claim 1, characterized in that the differential amplifier (106) is an operational amplifier.

3. Electric circuit (100,200) according to claim 1, characterized in that the electric conductor (10) is a thin elongated path (61).

4. Electric circuit (100,200) according to claim 3, characterized in that the electric conductor (10) is a thin elongated Indium Tin Oxide path (61).

5. Electric circuit (100, 200) according to claim 3, characterized in that the path (61) is on a sheet of glass (80).

6. Electric circuit (100,200) according to claim 1, characterized in that the circuit (100,200) forms part of a liquid crystal display unit.

7. Electric circuit (100,200) according to claims 1, characterized in that the circuit (100,200) forms part of a liquid crystal display unit in a mobile telephone unit.

8. Display unit (400) comprising an electric circuit (401, 100, 200) for eliminating an influence of a voltage drop (DV) between a first connection point (11) of an electric conductor (10) and a second connection point (12) on the conductor (10), said second connection point (12) connected to a first terminal (21) of an integrated circuit (20), the electric circuit (401, 100, 200) comprising:

a differential amplifier (106), said differential amplifier (106) comprises a first input terminal (103, 108) connected to a reference potential (303), and an output terminal (109) connected to the first connection point (11) on the conductor (10), and a feedback network connected to at least a second input terminal (104, 107) of the differential amplifier (106) and the integrated circuit (20) for compensation of said voltage drop (DV), wherein said first input terminal (108) is an inverting input terminal (108) of the differential amplifier (106), and wherein said feedback network comprises:

a first feedback connection (53) between a non-inverting input terminal (107) of the differential amplifier (106) and the first input terminal (21) of the integrated circuit (20) via the conductor (10), an output impedance unit (54) connected between the output terminal (109) of the differential amplifier (106) and the first connection point (11) on the conductor, and a second feedback impedance unit (56) connected between the inverting input terminal (108) of the differential amplifier (106) and the output terminal (109) of the differential amplifier (106).

9. Display unit (400) according to claim 8, characterized in that the differential amplifier (106) is an operational amplifier.

10. Display unit (400) according to claim 8, characterized in that the electric conductor (10) is a thin elongated path (61).

11. Display unit (400) according to claim 10, characterized in that the electric conductor (10) is a thin elongated Indium Tin Oxide path (61).

12. Display unit (400) according to claim 10, characterized in that the path (61) is on a sheet of glass (80).

13. Display unit (400) according to claim 8, characterized in that the display unit (400) is a liquid crystal display unit.

14. A system for compensating for voltage drops comprising:

a voltage supply unit;

an integrated circuit; and an electric circuit connected to said voltage supply unit and to said integrated circuit, said electric circuit comprising:

a differential amplifier having a first input terminal connected to said voltage supply unit for inputting a first voltage, a second input terminal connected to said integrated circuit, via a feedback connection, for inputting a second voltage, and an output terminal connected to said integrated circuit through an electric conductor for outputting a voltage, wherein said differential amplifier compensates for voltage drops across the electric conductor by adjusting said voltage output from said output terminal in response to a comparison of said first voltage and said second voltage.

15. The system of claim 14 wherein said first input terminal is a non-inverting input terminal and said second input terminal is an inverting input terminal.

16. The system of claim 14 wherein said electric conductor is a thin elongated path.

17. The system of claim 16 wherein said electric conductor is a thin elongated Indium Tin Oxide path.

18. The system of claim 17 wherein said path is on a sheet of glass.

* * * * *